United States Patent [19]

Grzeskowiak

[11] Patent Number: 4,847,191

[45] Date of Patent: Jul. 11, 1989

[54] SILVER HALIDE PHOTOGRAPHIC MATERIALS HAVING RHODIUM CYANIDE DOPANTS

[75] Inventor: Nicholas E. Grzeskowiak, Harlow, United Kingdom

[73] Assignee: Minnesota Mining and Manufacturing Company, St. Paul, Minn.

[21] Appl. No.: 34,419

[22] Filed: Apr. 3, 1987

[30] Foreign Application Priority Data

Apr. 15, 1986 [GB] United Kingdom ..... 8609135

[51] Int. Cl.[4] ..... G03C 1/08; G03C 5/16

[52] U.S. Cl. ..... 430/605; 430/569; 430/944; 430/584

[58] Field of Search ..... 430/605, 569

[56] References Cited

U.S. PATENT DOCUMENTS

| | | | |
|---|---|---|---|
| 3,790,390 | 2/1974 | Shiba et al. | 96/125 |
| 3,901,713 | 8/1975 | Yamasue et al. | 96/95 |
| 4,288,535 | 9/1981 | Kanisawa et al. | 430/569 |
| 4,477,561 | 10/1984 | Menjo et al. | 430/605 |
| 4,619,892 | 10/1986 | Simpson et al. | 430/505 |
| 4,621,041 | 11/1986 | Saikawa et al. | 430/605 |

OTHER PUBLICATIONS

Beck et al.: J. Signalaufzeichnungsmaterialen, 1976, 4, pp. 131–137.

*Primary Examiner*—Paul R. Michl
*Assistant Examiner*—Mark R. Buscher
*Attorney, Agent, or Firm*—Donald M. Sell; Walter N. Kirn; Mark A. Litman

[57] ABSTRACT

Photographic elements adapted for high intensity exposures of short dwell time, e.g. laser scanning which comprise a chemically working silver halide emulsion in which the silver halide grains were formed in the presence of one or more complex compounds of rhodium (III) having 3, 4, 5 or 6 cyanide ligands attached to each rhodium ion.

26 Claims, 2 Drawing Sheets

SILVER HALIDE PHOTOGRAPHIC MATERIALS HAVING RHODIUM CYANIDE DOPANTS

FIELD OF INVENTION

Figure 1:
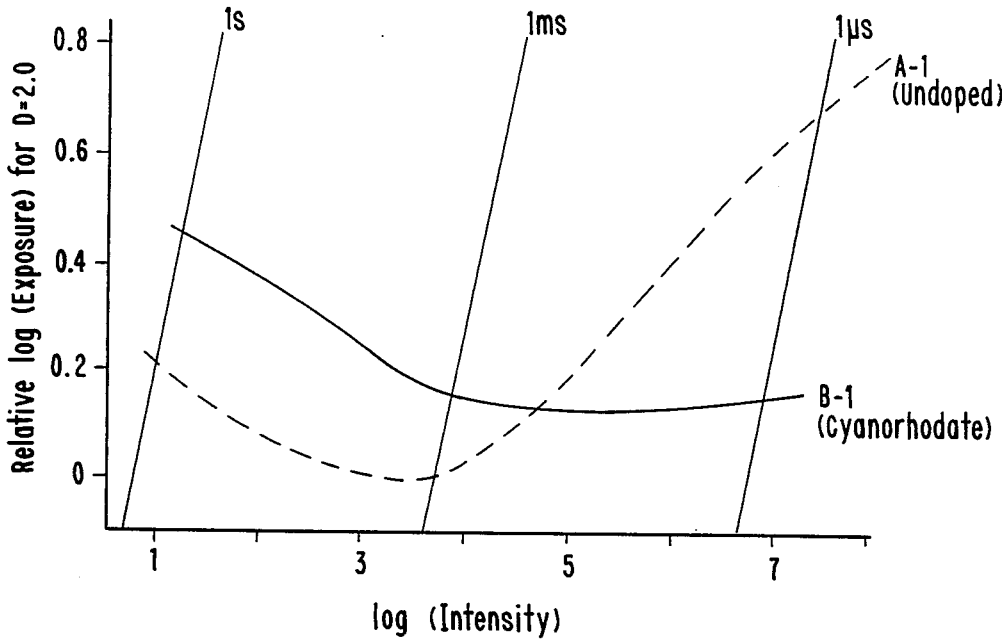
Figure 1:
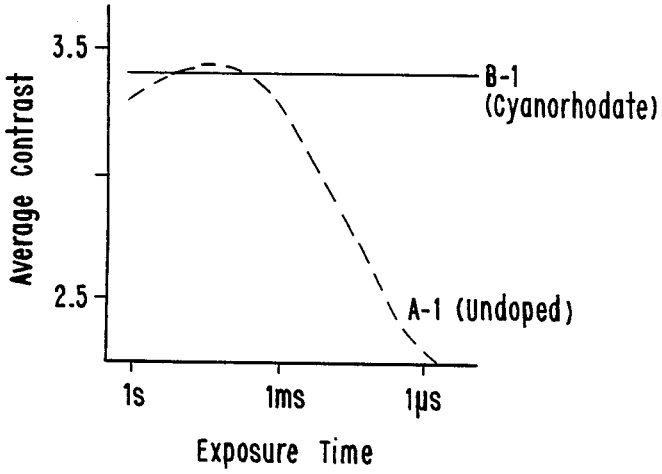

This invention relates to photographic elements comprising negative working silver halide emulsions and in particular to photographic elements adapted for high intensity exposures of short dwell time, e.g. laser scanning.

BACKGROUND TO THE INVENTION

Photographic elements for laser scanner imaging are designed to be imaged by electronically-modulated high resolution raster scanners, which scan the film with a very small spot of light from a high intensity source. Examples of high intensity sources include (i) gas lasers, especially argon ion, emitting at 488 nm, helium-neon, emitting at 633 nm, or helium-cadmium, emitting at 442 nm, (ii) near-infrared (NIR) laser diodes, which may emit light in the range 750–1500 nm, and (iii) light-emitting diodes (LED), which may emit in either the visible or NIR range. In all cases, the spot is scanned very rapidly, so that the dwell time on any part of the photographic element is short, typically from $10^{-7}$ to $10^{-6}$ seconds.

Silver halide photographic films usually respond optimally to exposures of duration of from 1 to 100 milliseconds, and tend to perform relatively badly under microsecond exposures, losing up to 1.0 logE in speed and 50% in average contrast. This is due to the phenomenon of high intensity reciprocity failure (HIRF), which also gives rise to related problems, such as:

(i) intermittency effects, which cause multiple superimposed short exposures to have a progressively greater effect as the time interval separating them is increased from microseconds to milliseconds or longer, (ii) latent image progression, whereby the latent image gives a stronger developed image when there is a delay period, especially of up to 1 hour, between exposure and development, (iii) unusually high sensitivity to development conditions, e.g. state of exhaustion of the developer.

It is desirable to overcome all these problems by making a photographic element which does not suffer from HIRF and thus responds equally to any given amount of exposure, regardless of how short or fragmented a form in which the exposure may be delivered.

It is known to prepare photographic emulsions containing small quantities of some Group VIII noble metal compounds. For example, U.S. Pat. No. 4,147,542 discloses photographic emulsion containing at least one compound belonging to Group VIII together with particular sensitising dyes. Such dopants are advantageously added during the crystal growth stages of emulsion preparation, i.e. during initial precipitation, and/or during physical ripening of the silver halide crystals. Halide compounds of rhodium and iridium are the dopants most commonly used in this way. When such dopants are incorporated into conventional, negative working photographic emulsions, certain specific photographic effects are obtained, depending on the particular compound employed.

For example, hexachloroiridate complex salts of formula $M_3IrCl_6$ or $M_2IrCl_6$ (where M is a Group I metal), are incorporated as emulsion dopants with consequent improvement in sensitivity to high intensity exposure, and reduction in the desensitisation usually caused by mechanical stress. This phenomenon is disclosed, for example, in British Patent Nos. 1 527 435 and 1 410 488, U.S. Pat. Nos. 4 126 472 and 3 847 621, German Patent No. DE 3 115 274, and French Patent No. 2 296 204.

The action on silver halide emulsions of halide compounds of rhodium is altogether different. These compounds produce the effect of increasing the contrast of the developed image, together with overall desensitisation of the emulsion. Rhodium doping is disclosed in a number of patents, e.g. rhodium trichloride in British Patent No. 775 197; sodium hexachlororhodate in British Patent No. 1 535 016; potassium hexachlororhodate in British Patent No. 1 395 923; ammonium hexachlororhodate (III) in British Patent No. 2 109 576 and U.S. Pat. No. 3,531,289, and rhodium chloride or trichloride in German Patent Nos. DT 2 632 202A, DE 3 122 921 and Japanese Application No. 74-33781.

In all the above patents, the practical examples of rhodium or iridium doping are exclusively confined to compounds of these metals having only chloride ligands or a majority of chloride ligands, the remaining ligands being water. They are applied in aqueous solution.

It is assumed that the useful effects, of contrast-increase from rhodium, and high intensity sensitisation from iridium, will be obtained irrespective of the type of compound of these metals which is used, i.e. without influence from the type of ligands attached to the rhodium or iridium ions. Thus, these patents predict that any rhodium compound (or any iridium compound, as appropriate to the individual patents) will be suitable for obtaining the useful effect disclosed in the respective patents.

Beck et al (J. Signalaufzeichnungsmaterialen, 1976, 4, p. 131) disclose the use of some rhodium compounds having ligands other than chloride, which were incorporated as dopants into silver bromide and chlorobromide emulsions, these emulsions being coated and examined sensitometrically as primitive emulsions, i.e. without chemical sensitisation. It was found that successive replacement by water of the chloride ligands in the hexachlororhodate complex causes a progressive reduction in the contrast-increasing effect of the rhodium, whilst the compounds $[Rh(dipyridyl)_2Cl_2]Cl$, and $[Rh(NH_3)_5Cl]Cl$ show small contrast increasing effects and $[Rh(NH_3)_6]Cl_3$ is inactive, in these emulsions. The preparation of primitive emulsions containing potassium hexacyanorhodate dopant is also disclosed and an increase in image contrast without the usual desensitisation is reported. The authors conclude that the "photographic rhodium effect" on the sensitivity and contrast is only observable when at least one halide or pseudo halide ligand is coordinated to rhodium.

Unlike iridium, the conventional rhodium chloride dopants do not protect emulsions against image degradation caused by high intensity exposure. Japanese Application No. 74-33781 discloses that whilst the image contrast of an emulsion doped with rhodium chloride or hexachlororhodate is extremely high in the case of ordinary exposure employing light of comparatively low intensity, it decreases considerably with exposure using a high intensity flash, and the result is as if the effect of the rhodium compound has been lost. For this reason, JA No. 74-33781, and British Patent No. 1 395 923 suggest the use of a mixture of rhodium and iridium dopants, in order to obtain good high contrast images from high intensity exposures.

Tests on an emulsion doped with sodium hexachlororhodate have confirmed that this dopant does not control high intensity reciprocity failure. Higher overall logE exposures are needed to give the same density when a high intensity exposure of 1 microsecond duration is used rather than an exposure in the normal millisecond to 1 second range. This reciprocity failure becomes progressively worse at higher image densities, hence the loss in image contrast with brief, high intensity exposures.

We have now found that HIRF can be significantly reduced or prevented in chemically sensitised negative working silver halide emulsions by a particular class of rhodium dopants.

SUMMARY OF THE INVENTION

According to the present invention there is provided a photographic element comprising a chemically sensitised, negative working silver halide emulsion, the silver halide grains having been formed in the presence of one or more complex compounds of rhodium (III) having 3, 4, 5 or 6 cyanide ligands attached to each rhodium ion.

References to rhodium (III) refer to rhodium in the +3 oxidation state.

The photographic elements of the invention are adapted for exposure by scanners and other high intensity devices without the loss of speed and contrast caused by high intensity reciprocity failure which is exhibited by unprotected films under such exposures of short dwell time. The means by which this is achieved is by addition during growth of the silver halide crystals of a class of rhodium compounds, having at least three cyanide ligands attached to each rhodium atom. The surprising effect of this particular class of rhodium compounds is that the usual well known desensitisation and contrast-increasing functions of other rhodium compounds are suppressed, and the ability to prevent high intensity reciprocity failure significantly and unexpectedly enhanced.

It has been found that when rhodium complexes in which three or more of the ligands attached to the $Rh^{3+}$ ion are cyanide groups (referred to herein as rhodium cyanide complexes) are incorporated into the silver halide crystals of photographic emulsions and the resulting emulsions chemically and spectrally sensitised by the usual methods, they give sensitometric results similar to undoped emulsions when subjected to normal exposures of 1 ms duration or longer. Even relatively high levels of these rhodium cyanide complex compounds do not produce the effects of high contrast and heavy desensitisation which result from similar use of the well-known rhodium trichloride or halorhodate compounds, e.g. $Na_3RhCl_6$.

When evaluated by 488 nm laser reciprocity sensitometry, using exposures ranging from 1 microseconds to 0.2 microseconds, the emulsions of the invention doped with a rhodium cyanide complex are surprisingly found to exhibit no high intensity reciprocity failure (HIRF). The emulsions of the invention give an ideal, flat log(Exposure) v. log(Intensity) i.e. (logE v. logI), response to exposures in the millisecond to submicrosecond range, and cause contrast to remain unchanged at a satisfactory value throughout the time range. As is the case when using iridium compounds for HIRF control, there is some overall desensitisation compared with the 1 to 10 ms sensitivity maximum of an identical but untreated emulsion, but this desensitisation is small compared to the speed gain at 1 microsecond or shorter exposure due to elimination of HIRF. A surprising difference from the effect produced by iridium is that rhodium cyanides actually causes an increase in low intensity reciprocity failure (LIRF). They are thus doubly advantageous in giving an emulsion which has (i) uniform optimum sensitivity both to submicrosecond scanner exposures and to conventional millisecond flash exposures and (ii) has reduced sensitivity to long exposures from low level background light.

The rhodium cyanide complex compounds have also been tested in emulsions spectrally sensitised to near infrared radiation. Laser diode reciprocity sensitometry at 815 nm shows that the HIRF present in the undoped emulsion is again eliminated by this dopant.

Cyanorhodate complexes are prepared from other rhodium compounds by displacement of ligands by cyanide. The hexacyanorhodate complex $[Rh(CN)_6]^{3-}$, is known to be prepared by fusion of rhodium salts with excess solid potassium cyanide, for example A. W. Addisson, R. D. Gillard and D. H. Vaughan, J. Chem. Soc. Dalton Trans., 1973, p1187 discloses fusion of rhodium trichloride in KCN, precipitating the hexacyanorhodate with the complex hexa-amminecobalt cation, i.e. as $[Co(NH_3)_6]^{3+}[Rh(CN)_6]^{3-}$, F. Krauss and H. Umbach, Z Anorg. Allg. Chem., 1929, 179, p357 discloses fusion of $[Rh(NH_3)_5Cl]Cl_2$ in KCN and a flux, obtaining $K_3Rh(CN)_6$. Schmidtke, Z. Physikalische Chem., 1964, 40, p96 described the preparation of $K_3Rh(CN)_6$ by heating rhodium trichloride with six molar equivalents of potassium cyanide in water, followed by lengthy fractional crystallisation.

It has been found that reactions of rhodium trichloride with potassium cyanide in aqueous solution are advantageous for preparation of cyanide substituted rhodium complexes. However, even prolonged heating of rhodium chloride with six molar equivalents of potassium cyanide in concentrated aqueous solution at 100° C. afforded not the hexacyanorhodate, but a mixture of cyanorhodate complexes having four and five cyanide ligands per rhodium ion. After destruction of excess KCN this was used directly as dopant, avoiding wasteful and time-consuming separation procedures. Rhodium trichloride with three equivalents of KCN in water gives a sparingly soluble rhodium tricyanide complex compound. Any of these cyanide-substituted rhodium complexes having three or more cyanide ligands per rhodium atom performs well as the dopant in this invention.

The rhodium cyanide complex compounds are advantageously added before or during the crystal growth stages of the silver halide crystals in order to form silver halide grains in their presence. For example, the rhodium cyanide complex compound may be added to the mixing vessel prior to addition of the silver ion and halide solutions. Preferably, the rhodium cyanide complex compounds are incorporated in the halide feedstock prior to the reaction with silver ions to precipitate silver halide. The rhodium cyanide complex compounds may also be added or incorporated during physical ripening of the silver halide crystals in order to form silver halide grains in their presence. In general the quantity of rhodium cyanide compound used during formation of the silver halide grains is in the range $10^{-8}$ to $10^{-3}$ molar equivalents of rhodium cyanide complex compound per molar equivalent of silver, preferably from $10^{-6}$ to $10^{-4}$ molar equivalent of rhodium cyanide complex compound per molar equivalent of silver.

The rhodium cyanide complex compounds used in the invention may be employed in combination with other dopants. A particularly preferred combination comprises a rhodium cyanide complex compound and a hexachlororhodate, e.g. sodium or potassium hexachlororhodate, in a molar ratio of from 10:1 to 500:1, preferably 40:1 to 200:1.

The rhodium cyanide complex compounds may be usefully employed in a broad variety of photographic materials, which are required to be scanner compatible. Different shapes and compositions of silver halide grains, types of chemical sensitisation, spectral sensitisation to any wavelength, types of photographic construction giving, for example black developed silver images or single- or multi-layer colour images by colour development, dye bleach or dye release, and different methods of image retention, e.g. conventional non-diffusive dyes/silver or diffusion transfer of dyes, or migration of silver to physical development nuclei, are widely reported in the photographic art and may be employed in the practice of the invention. Examples of suitable silver halide emulsion types and photographic constructions are described in Research Disclosure No. 17643, December 1978.

The invention is also applicable to tabular grain emulsions, e.g. as disclosed in Research Disclosure No. 22534, January 1983, and references cited therein, but excluding the part of this disclosure relating to direct reversal emulsions. The emulsions of this invention may also be spectrally sensitised to infrared radiation as described in U.S. Pat. No. 4 515 888, and references cited therein.

The emulsions of the invention may be chemically sensitised with a wide range of sensitising dyes. Dyes suitable for sensitisation to near infrared include those of the general formula:

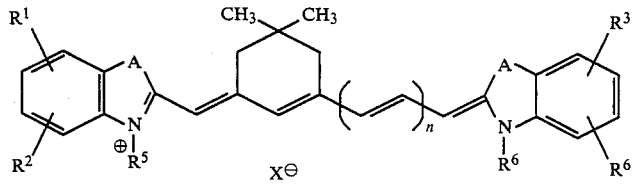

in which:

n is 0, 1 or 2

$R^1$, $R^2$, $R^3$ and $R^4$ are independently selected from hydrogen, halogen, alkyl groups of 1 to 4 carbon atoms, alkoxy groups of 1 to 4 carbon atoms and other aliphatic groups of 1 to 4 carbon atoms, any of which groups may be substituted by substituents such as halogen, OH, etc, or $R^1$ and $R^2$ or $R^3$ and $R^4$ may together represent the necessary atoms to complete a carbocyclic or heterocyclic 5- or 6- membered ring, $R^5$ and $R^6$ are independently selected from aliphatic groups of 1 to 5 carbon atoms e.g. alkyl, carboxyalkyl, sulphoalkyl, A is selected from O, S and Se, and $X^{\ominus}$ is an anion e.g. halide.

Other sensitising dyes include those of the general formulae:

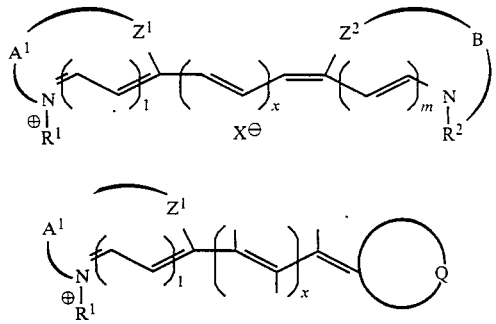

in which:

x is 0 or an integer of 1 to 5

$R^1$ and $R^2$ are as defined above, $Z^1$ and $Z^2$ are independently selected from O, S, Se, N-$R^1$ and CH, when $Z^1$ is CH $\tau$ may be 0 or 1, otherwise $\tau$ is 0, when $Z^2$ is CH m may be 0 or 1, otherwise m is 0, $A^1$ and B represent the necessary atoms to complete five or six membered heterocyclic rings, which may optionally be fused with aromatic or heteroaromatic rings and may optionally have alkyl, aryl, halogen, pseudohalogen i.e. thiocyanate, alkoxy, alkylthio, alkylamino substituents.

Q represents the components needed to complete an acidic nucleus such as can be derived from barbituric acid, 2-thiobarbituric acid, rhodanine, hydantoin, 2 thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkyl-sulphonylacetonitrile, malononitrile, isoquinolin-4-one, and chroman-2,4-dione, the free bonds on the polymethine chain represent hydrogen atoms or any chain sustituents known in the cyanine dye art, such as lower alkyl groups of 1 to 5 carbon atoms, aryl and heteroaryl groups or two or more substitutents may combine together with the chain to form a 5- or 6-membered carbocyclic ring e.g. cyclopentyl.

Elements of the invention may be exposed to any of the laser or emitting diode sources referred to previously or alternatively to broad spectrum light sources with emissions narrowed by use of filters. Other high intensity sources such a line sources may also be used.

The invention will now be illustrated by the following Examples in which the performance of all the film coatings made from the variously treated or untreated emulsions described was evaluated using a special sensitometric technique, hereafter referred to as "reciprocity sensitometry".

This test was performed at 488 nm using a scanner device having an argon ion laser as light source, whereby a series of exposures consisting of a single scanned line were made. By altering the speed at which the beam was scanned, five different exposures having respective dwell times of 0.2 microseconds, 2 microseconds, 7 microseconds, 21 microseconds and 105 microseconds were made. In addition, static line exposures using the same laser source were made having duration of 108 microseconds, 0.9 milliseconds, 11 milliseconds, 0.13 seconds and 1.1 seconds. For each of these 10 exposure durations, several exposures of different intensity were made by passing the laser beam through neutral density filters, precisely calibrated at the exposing wavelength. After simultaneous processing of these tests, microdensitometry enabled exactly comparable characterstic (D-logE) curves to be constructed for each of the exposure durations. These data are presented in the form of conventional reciprocity graphs, depicting the total log(Exposure), i.e. log(intensity x time), needed to produce a chosen density of developed silver, plotted against the log(Intensity) (and hence duration) of the exposure. In addition, tables are provided of the same log(Exposure) values at selected exposure durations, and of the average contrast of the materials, measured between densities of 0.5 and 2.0.

Similar tests were made on NIR sensitive films using a laser diode emitting at 815 nm, using a range of scanner exposures of dwell times from 0.5 microseconds to 0.37 milliseconds.

All the test strips were developed and fixed in a conventional rapid access roller processing machine. The 488 nm tests were processed in 3M RDC chemistry (commercially available from Minnesota Mining and Manufacturing Company), and the 815 nm tests in Kodak RP X-OMAT chemistry (commercially available from Eastman Kodak Company).

EXAMPLE 1

Preparation of Cyanorhodate Complex by Reaction of Rhodium Trichloride with Six Molar Equivalents of Potassium Cyanide in Aqueous Solution Rhodium trichloride (2.0 g) was dissolved in water (30 ml) under heating to 60° to 80° C. Potassium cyanide (1.6 g) in water (20 ml) at 60° to 80° C. was added to the rhodium solution, causing a mustard coloured precipitate to form. Further potassium cyanide (1.6 g) was added to the reaction mixture, which was then vigorously heated at 100° C. causing the volume to be greatly reduced, whereupon a clear yellow syrup was formed. This mixture was heated gently at 100° C. for 30 minutes, controlling water loss so that only a few white crystals formed in the reaction mixture. Water (30 ml) was added, and 1M hydrochloric acid introduced dropwise until the pH of the solution was 3 to 4. Hydrogen cyanide was removed by heating the solution vigorously at 100° C. whilst passing a current of air over the surface. The residual solution was evaporated to dryness with portions of ethanol, giving a mixture of the cyanorhodate complex with potassium chloride as a white powder (4.0 g). The infrared spectrum (Nujol) showed a strong, sharp absorption at 2130 $cm^{-1}$ and a weaker, broader band at 2200 $cm^{-1}$.

(a) Analysis of Crude Cyanorhodate Complex. The mixture of cyanorhodate complex with potassium chloride was dried and analysed without further purification:

Found Rh=15.20; C=7.93; H<0.2; N=9.35%.

Ratio of Rh:C=1:4.47; Rh:N=1:4.52.

The rhodium ion is therefore associated with an average 4.5 cyanogroups in this product.

(b) Analysis of Cyanorhodate Partly Separated from KCl. The crude mixture was fractionally crystallised from aqueous ethanol, (causing partial removal of the potassium chloride impurity), dried and analysed:

Found Rh=19.50; C=10.15; H=0.10; N=12.35%.

Ratio of Rh:C=4.48; Rh:N=4.67.

The same Rh:CN ratio of 1:4.5 in the crude and purified sampled indicates that whilst (inert) KCl impurity is removable, the components of the cyanorhodate complex mixture are not readily separable by crystallisation.

(c) The crude product in (a) above was dissolved in water to give a solution 0.04M in rhodium, for direct use as a dopant.

EXAMPLE 2

Preparation of Rhodium Tricyanide Complex

Rhodium trichloride (2.0 g) in water (40 ml) at 60° to 80° C., was mixed with potassium cyanide (1.6 g) in water (60 ml) at 60° to 80° C., and the mixture heated to 100° C. for 5 minutes. After filtering off the initial light precipitate, the filtrate was evaporated (with ethanol) to give the rhodium tricyanide as a yellow powder. This compound gave an infrared spectrum (Nujol) having weak bands at 2140 and 2200 $cm^{-1}$.

Found Rh=30.4; C=11.18; H=0.65; N=12.05%.

Ratio Rh:C=1:3.16; Rh:N=1:2.92.

Thus, the Rh:CN ratio is an average 1:3.

EXAMPLE 3

Preparation of Silver Chromobromide Emulsions Containing Rhodium Cyanide Compounds as Dopants, and of Undoped Reference Emulsions

| | | | |
|---|---|---|---|
| I. | The following solutions were prepared: | | |
| | 75% Phthalated gelatin | 28.8 g | admixed at 55° C. |
| | Water | 228 ml | |
| | 0.1% adenine | 40 ml | |
| II. | | | |
| | 2.5 M $NH_4Cl$ | 250 ml | admixed at 43° C. |
| | 2.5 M $NH_4Br$ | 144 ml | |
| | Water | 206 ml | |
| III. | | | |
| | 2.5 M $AgNO_3$ | 400 ml | admixed at 43° C. |
| | Water | 200 ml | |

Emulsion A Undoped (Reference). To solution I, maintained at 55° and well stirred, were added solutions II and III by the simultaneous double jet method, initially at 12 ml/minute, increasing to 19 ml/minutes after 8 minutes of addition. The emulsion was coagulated by acid addition, washed and reconstituted with inert bone gelatine.

Emulsion B. Doped with Cyanorhodate Complex. To the halide solution (II) was added 1 ml (40 micromoles) of the cyanorhodate solution described in Example 1, part (c). The emulsion was then prepared in the same manner as Emulsion A.

Emulsion C. Doped with Rhodium Tricyanide. To the halide solution II was added 20 mg (60 micromoles) of the rhodium tricyanide complex described in Example 2. The emulsion was then prepared in the same manner as A.

Emulsion D. Doped with Potassium Hexacyanorhodate. To the halide solution (II) was added 15 mg (40 micromoles) of pure crystalline potassium hexacyanorhodate (commercially available from ICN Pharmaceuticals Limited). The emulsion was then prepared in the same manner as A.

EXAMPLE 4

Chemical and Optical Sensitisation of Rhodium Cyanide Doped Emulsions, and Reciprocity Sensitometry at 488 nm (a) Comparison of Cyanorhodate Doped Emulsion "B" with Undoped Reference "A". The emulsion "B" described in Example 3 was conventionally gold and sulphur sensitised by heating with sodium thiosulphate and gold chloride until optimum speed was reached, whereupon a tetraazindene stabilizer was added. It was then spectrally sensitised with dye I. The resulting emulsion was coated on polyester base with a supercoat of inert gelatine, using conventional wetting agents and formaldehyde hardener (Coating B-1).

Dye I

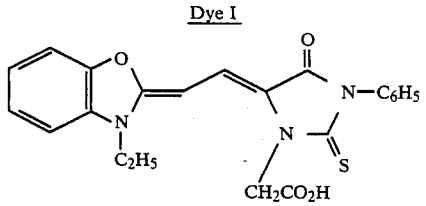

The undoped emulsion A was identically sulphur and gold sensitised, and coated with the same additions to give a reference coating. (Coating A-1).

The coating B-1 and A-1 were subjected to reciprocity sensitometry at 488 nm as described above and the results are reported in Table 1.

FIG. 1 of the accompanying drawings is a graphical representation of the reciprocity data as a conventional log(Exposure) V log(Intensity) plot showing the exposure needed to generate an image of optical density (O.D.)=2.0, at different exposure durations. Larger values of log(Exposure) indicate lower sensitivity. Both emulsions have high sensitivity at a conventional exposure duration of 1 millisecond. The cyanorhodate doped emulsion B-1 does not suffer from HIRF and retains high sensitivity and contrast to 0.2 microseconds. In comparison, the undoped emulsion (A-1) suffers a continuous, severe loss in sensitivity and contrast down to microsecond exposures. The enhanced LIRF (decreased sensitivity to long exposures) of the cyanorhodate doped emulsion can be seen in FIG. 1.

(b) Comparison of Rhodium Tricyanide Doped Emulsion "C" with Undoped Reference. The emulsion "C" in Example 3 was chemically sensitised, dyed and coated exactly as in part (a) of this Example (Coating C-1), as was an undoped reference (Coating A-2). These coatings were tested by reciprocity sensitometry and the results recorded in Table 1. As with cyanorhodate, the rhodium tricyanide dopant gives protection against HIRF, so that the emulsion retains high sensitivity and contrast at very short exposure times.

(c) Comparison of Hexacyanorhodate Doped Emulsion "D" with Undoped Reference. The hexacyanorhodate doped emulsion "D" in Example 3 was chemically sensitised with gold chloride and sodium thiosulphate, stabilised with tetraazindene, spectrally sensitised with dye I, and coated (Coating D-1) as in part (a) of this Example. An undoped reference (Coating A-3) was sensitised and coated in exactly the same manner. Reciprocity sensitometry for these coatings is reported in Table 1. The hexacyanorhodate dopant also prevents HIRF and causes sensitivity and contrast to be maintained for microsecond exposures.

TABLE 1

488 nm RECIPROCITY SENSITOMETRY FOR THE COATINGS OF EXAMPLE 4

| | | Relative log (Exposure) to give D = 2.0 | | Contrast (D = 0.5, 2.0) | |
|---|---|---|---|---|---|
| Coating | Dopant | at 1 ms | at 0.2 micro-sec | at 1 ms | at 0.2 micro-sec |
| B-1 | Cyanorhodate (Invention) | 0.16 | 0.19 | 3.4 | 3.4 |
| A-1 | Undoped (Reference) | 0.0 | 0.78 | 3.4 | 2.4 |
| C-1 | Rhodium Tricyanide (Invention) | 0.18 | 0.28 | 3.1 | 3.5 |
| A-2 | Undoped (Reference) | 0.0 | 0.74 | 3.5 | 2.1 |
| D-1 | Potassium Hexacyanorhodate (Invention) | 0.29 | 0.34 | 3.3 | 3.3 |
| A-3 | Undoped | 0.0 | 0.69 | 3.4 | 1.9 |

EXAMPLE 5

Preparation of Silver Chlorobromide Emulsions Containing Dopants Other Than Rhodium Cyanide (For Comparison With Invention)

Emulsion E. Doped with Sodium Hexachlororhodate. This emulsion was prepared in the same manner as Emulsion A in Example 3, except that 0.3 mg ($5\times10^{-7}$ molar equivalents) of sodium hexachlororhodate ($Na_3RhCl_6.12H_2O$) was added to the halide solution (II), just before commencing precipitation.

Emulsion F. Doped with Potassium Hexacyanoiridate. This was prepared the same as Emulsion A in Example 3, except that 23.25 mg ($5\times10^{-5}$ molar equivalents) of potassium hexacyanoiridate ($K_3Ir(CN)_6$)(commercially available from ICN Pharmaceuticals Limited) was added to the halide solution (II) just before commencing precipitation.

EXAMPLE 6

Chemical and Optical Sensitisation of Emulsions Containing Dopants Other Than Rhodium Cyanide Compounds and 488 nm Reciprocity Sensitometry (Comparison with Invention)

(a) Conventional Chlororhodate Dopant The emulsion "E" described in Example 5, doped with sodium hexachlororhodate, was chemically and spectrally sensitised and coated in the same manner as in Part (a) of Example 4. (Coating E-1). This coating was evaluated by laser reciprocity sensitometry at 488 nm, using the undoped coating A-1 (see Example 4) as a reference and the results are reported in Table 2.

The chlororhodate dopant causes E-1 to have a very high contrast when exposed for the normal 1 millisecond duration, and to be desensitised compared with the undoped emulsion, as would be expected. At microsecond dwell times E-1 is affected by HIRF and exhibits a further drop in sensitivity, also losing the ability to give very high contrast.

(b) Cyanoiridate Dopant. The cyanoiridate doped emulsion "F" described in Example 5 was chemically and optically sensitised and coated in the same manner as in part (a) of Example 4. (Coating F-1). An undoped reference coating (A-4) was likewise prepared. Reciprocity sensitometry at 488 nm was performed on these coatings, and the results shown in Table 2.

The cyanoiridate dopant in F-1 has no ability to control reciprocity failure.

TABLE 2

488 nm RECIPROCITY SENSITOMETRY FOR THE COATINGS OF EXAMPLE 6

| Coating | Dopant | Relative log (Exposure) to give D = 2.0 at 1 ms | Relative log (Exposure) to give D = 2.0 at 0.2 microsec | Contrast (D = 0.5, 2.0) at 1 ms | Contrast (D = 0.5, 2.0) at 0.2 microsec |
|---|---|---|---|---|---|
| E-1 | $Na_3RhCl_6$ (Comparison) | 0.86 | 1.07 | 5.6 | 4.4 |
| A-1 | Undoped (Reference) | 0.0 | 0.78 | 3.4 | 2.4 |
| F-1 | $K_3Ir(CN)_6$ (Comparison) | 0.1 | 0.60 | 3.1 | 1.8 |
| A-4 | Undoped (Reference) | 0.0 | 0.70 | 3.2 | 2.4 |

EXAMPLE 7

Chemical and NIR Optical Sensitisation of Cyanorhodate Doped Emulsion and 815 nm Reciprocity Sensitometry in Comparison with an Undoped Coating The cyanorhodate doped emulsion B was chemically sensitised and coated in the same manner as in Part (a) of Example 4, except that the solution of dye I was omitted, and the following added in its place:

15 ml/mole Ag of 0.4% Dye II in methanol 50 ml/mole Ag of 0.5% triphenylphosphine in methanol Dye II

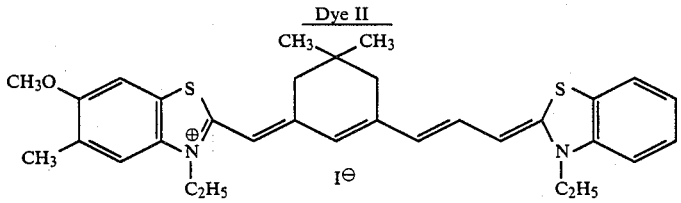

This coating is referred to herein as Coating B-2.

Figure 2:
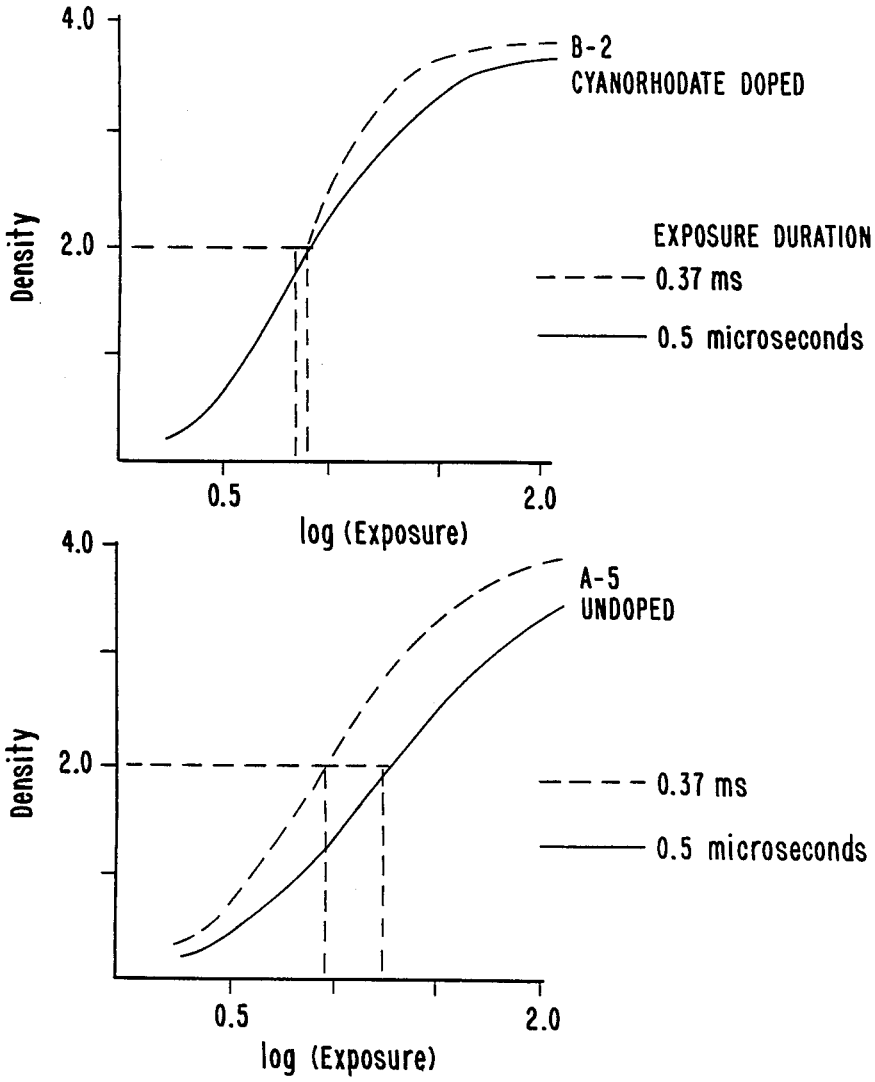

A NIR sensitised undoped reference coating (A-5) was made in the same way. Laser diode reciprocity sensitometry at 815 nm was carried out on these coatings and the results are reported in Table 3. FIG. 2 of the accompanying drawings compare the D-logE curves for the shorter/longer exposures for these coatings.

The results show the ability of the cyanorhodate dopant to prevent high intensity reciprocity failure in this type of infrared sensitised material as well as for green sensitised emulsions.

TABLE 3

815 nm LASER DIODE RECIPROCITY SENSITOMETRY

| Coating | Dopant | Relative log (Exposure) to give D = 2.0 at 0.37 ms | Relative log (Exposure) to give D = 2.0 at 0.5 microsec | Contrast (D = 0.5, 2.0) at 0.37 ms | Contrast (D = 0.5, 2.0) at 0.5 microsec |
|---|---|---|---|---|---|
| B-2 | Cyanorhodate (Invention) | −0.06 | −0.02 | 3.1 | 2.8 |
| A-5 | Undoped (Reference) | 0.0 | 0.30 | 2.8 | 2.1 |

EXAMPLE 8

Preparation, Sensitisation and 488 nm Testing of an Emulsion Containing Both Cyanorhodate and Chlororhodate Dopants.

A chlorobromide emulsion was prepared, the same as Emulsion A in Example 3, but additionally containing 23 mg ($6\times10^{-5}$ moles) of potassium hexacyanorhodate, $K_3Rh(CN)_6$ (commercially available from ICN Pharmaceuticals) and 0.24 mg ($0.4\times10^{-6}$ moles) of sodium hexachlororhodate, $Na_3RhCl_6.12H_2O$, both these dopants being added to the halide solution (II) just prior to precipitation. This emulsion (G) was chemically sensitised, optically sensitised to green light with dye I and coated in the same manner as in art (a) of Example 4. (Coating G-1). The 488 nm reciprocity sensitometry data are reported in Table 4, reference to the undoped coating A-1. It can be seen that this combination of dopants gives a very high contrast at the conventional 1 millisecond exposure duration, and that this contrast remains high at the shortest exposure times. There is negligible speed loss due to HIRF.

TABLE 4

488 nm RECIPROCITY SENSITOMETRY FOR THE COATINGS OF EXAMPLE 8

| Coating | Dopant | Relative log (Exposure) to give D = 2.0 at 1 ms | Relative log (Exposure) to give D = 2.0 at 0.2 microsec | Contrast (D = 0.5, 2.0) at 1 ms | Contrast (D = 0.5, 2.0) at 0.2 microsec |
|---|---|---|---|---|---|
| G-1 | $K_3Rh(CN)_6$ + $Na_3RhCl_6$ (Invention) | 0.73 | 0.79 | 7.5 | 7.1 |
| A-1 | Undoped | 0.0 | 0.78 | 3.4 | 2.4 |

TABLE 4-continued

| 488 nm RECIPROCITY SENSITOMETRY FOR THE COATINGS OF EXAMPLE 8 | | | | | |
|---|---|---|---|---|---|
| | | Relative log (Exposure) to give D = 2.0 | | Contrast (D = 0.5, 2.0) | |
| Coating | Dopant | at 1 ms | at 0.2 microsec | at 1 ms | at 0.2 microsec |
| | (Reference) | | | | |

We claim:

1. A photographic element comprising a chemically sensitised, negative working spectrally sensitized silver halide emulsion characterised in that the silver halide grains were formed in the presence of one or more complex compounds of rhodium (III) having 3, 4, 5 or 6 cyanide ligands attached to each rhodium ion.

2. An element as claimed in claim 1 characterised in that the quantity of dopant present during the formation of silver halide grains is in the range $10^{-8}$ to $10^{-3}$ molar equivalents of rhodium cyanide complex compound per mole equivalent of silver.

3. An element as claimed in claim 2 characterised in that the quantity of dopant present during the formation of silver halide grains is in the range of $10^{-6}$ to $10^{-4}$ molar equivalents of rhodium cyanide complex compound per mole equivalent of silver.

4. An element as claimed in claim 2 characterised in that the rhodium complex compound comprises 3 or more cyanide ligands per rhodium ion and at least one of the ligands is halide or water.

5. An element as claimed in claim 4 characterised in that the remaining ligands are chloride or water.

6. An element as claimed in claim 2 characterised in that the rhodium cyanide complex compound is the hexacyanorhodate complex.

7. An element as claimed in claim 2 characterised in that the rhodium cyanide complex compound is the product resulting from the reaction of rhodium trichloride with six molar equivalent of potassium or sodium cyanide in concentrated aqueous solution at elevated temperature.

8. An element as claimed in claim 2 characterised in that the rhodium cyanide complex compound comprises a rhodium compound resulting from the reaction rhodium trichloride with 3 molar equivalents to potassium or sodium cyanide in aqueous solutions.

9. An element as claimed in claim 1 characterised in that the rhodium cyanide complex compound was incorporated into the silver halide crystal during crystal growth as an additive to the halide feedstock prior to reaction with silver of precipitated silver halide.

10. An element as claimed in claim 2 characterised in that the rhodium cyanide complex compound was added to the silver halide crystal during physical ripening.

11. A photographic element as claimed in claim 1 characterised in that the silver halide grains were formed in the presence of one or more rhodium cyanide complex compounds and a hexachlororhodate in a molar ratio in the range 10:1 to 500:1.

12. A method of recording an image characterised in that the method comprises exposing a photographic element as claimed in claim 1 and thereafter processing the element to develop an image.

13. A method as claimed in claim 12 characterised in that the element is exposed by a high intensity source for a dwell time of less than 1 ms.

14. A method as claimed in claim 12 characterised in that the dwell time is in the range of $10^{-7}$ to $10^{-6}$ seconds.

15. A method as claimed in claim 12 in which the high intensity source is selected from a gas laser, a near-infrared laser diode, a light emitting diode and an infrared emitting diode.

16. A method of manufacturing a silver halide emulsion in which one or more complex compounds of rhodium having 3, 4, 5 or 6 cyanide ligands attached to each rhodium atom are present during the crystal growth stages of the silver halide.

17. A method as claimed in claim 16 in which the rhodium cyanide compound is present in the halide feedstock prior to reaction with silver to precipitate silver halide.

18. A method as claimed in claim 16 in which the quantity of rhodium cyanide compound used is in the range of $10^{-8}$ to $10^{-3}$ molar equivalents of rhodium cyanide compound per molar equivalent of silver.

19. A method as claimed in claim 16 in which the quantity of rhodium cyanide compound used is in the range of $10^{-6}$ to $10^{-4}$ molar equivalents of rhodium cyanide compound per molar equivalent of silver.

20. A photographic element according to claim 1 in which the emulsion comprises a sensitising dye of the general formula:

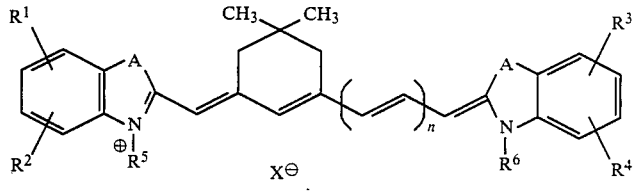

in which:

n is 0, 1 or 2

$R^1$, $R^2$, $R^3$ and $R^4$ are independently selected from hydrogen, halogen, alkyl groups of 1 to 4 carbon atoms, alkoxy groups of 1 to 4 carbon atoms and other aliphatic groups of 1 to 4 carbon atoms, any of which groups may be substituted by substituents such as halogen, OH, etc, or $R^1$ and $R^2$ or $R^3$ and $R^4$ may together represent the necessary atoms to complete a carbocyclic or heterocyclic 5- or 6-membered ring, $R^5$ and $R^6$ are independently selected from aliphatic groups of 1 to 5 carbon atoms e.g. alkyl, carboxyalkyl, sulphoalkyl, A is selected from O, S and Se, and $X^-$ is an anion; or

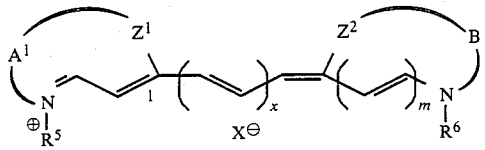

or

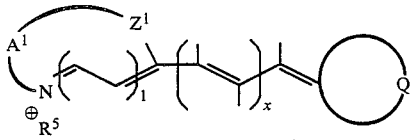

in which:

x is 0 or an integer of 1 to 5

$R^1$ and are as defined above, $Z^1$ and $Z^2$ are independently selected from O, S, Se, N—$R^5$ and CH, when $Z^1$ is CH, l may be 0 or 1, otherwise l is 0, when $Z^2$ is CH, m may be 0 or 1, otherwise m is 0, $A^1$ and B represent the necessary atoms to complete five or six membered heterocyclic rings, which may optionally be fused with aromatic or heteroaromatic rings and may optionally have alkyl, aryl, halogen, pseudo-halogen, alkoxy, alkylthio, or alkylamino substituents, Q represents the components needed to complete an acidic nucleus, the free bonds on the polymethine chain represent hydrogen atoms or any chain substituents, known in the cyanine dye art, or two or more substituents may combine together with the chain to form a 5- or 6- membered carbocyclic ring.

21. A photographic element comprising a chemically sensitised, negative working silver halide emulsion spectrally sensitized to the near-infrared characterised in that the silver halide grains were formed in the presence of one or more complex compounds of rhodium (III) having 3, 4, 5 or 6 cyanide ligands attached to each rhodium ion.

22. An element as claimed in claim 21 characterised in that the quantity of dopant present during the formation of silver halide grains is in the range $10^{-8}$ to $10^{-3}$ molar equivalents of rhodium cyanide complex compound per mole equivalent of silver and said grains exhibit no increase in contrast in comparison with grains which are otherwise identical except for the absence of said dopant.

23. An element as claimed in claim 22 characterised in that the quantity of dopant present during the formation of silver halide grains is in the range of $10^{-6}$ to $10^{-4}$ molar equivalents of rhodium cyanide complex compound per mole equivalent of silver.

24. An element as claimed in claim 21 characterised in that the rhodium complex compound comprises 3, 4, or 5 cyanide ligands per rhodium ion and any remaining ligands are halide or water.

25. A method of recording an image characterised in that the method comprises exposing a photographic element as claimed in claim 22 and thereafter processing the element to develop an image.

26. A photographic element as claimed in claim 22 characterised in that the silver halide grains were formed in the presence of one or more rhodium cyanide complex compounds and a hexachlororhodate in a molar ratio in the range 10:1 to 500:1.

* * * * *